US007661283B2

(12) United States Patent
Hori et al.

(10) Patent No.: US 7,661,283 B2
(45) Date of Patent: Feb. 16, 2010

(54) BULGING METHOD AND APPARATUS

(75) Inventors: Izuru Hori, Tochigi-ken (JP); Daisuke Yamamoto, Utsunomiya (JP); Keishi Okunaka, Utsunomiya (JP); Yuichi Nagai, Utsunomiya (JP); Kouki Mizutani, Utsunomiya (JP)

(73) Assignee: Honda Motor Co., Ltd., Tokyo (JP)

( * ) Notice: Subject to any disclaimer, the term of this patent is extended or adjusted under 35 U.S.C. 154(b) by 137 days.

(21) Appl. No.: 11/911,614

(22) PCT Filed: Dec. 22, 2006

(86) PCT No.: PCT/JP2006/325599

§ 371 (c)(1),
(2), (4) Date: Oct. 15, 2007

(87) PCT Pub. No.: WO2008/078356

PCT Pub. Date: Jul. 3, 2008

(65) Prior Publication Data

US 2008/0307848 A1 Dec. 18, 2008

(51) Int. Cl.
*B21D 26/02* (2006.01)
*B21D 51/16* (2006.01)

(52) U.S. Cl. ..... 72/58; 72/61; 72/62; 72/370.22; 148/520; 29/421.1

(58) Field of Classification Search ..... 72/57, 72/58, 60, 61, 62, 342.94, 370.06, 370.22, 72/370.24, 709; 148/520, 570; 29/421.1
See application file for complete search history.

(56) References Cited

U.S. PATENT DOCUMENTS

| | | | | |
|---|---|---|---|---|
| 5,239,852 | A * | 8/1993 | Roper | 72/58 |
| 5,865,054 | A * | 2/1999 | Roper | 72/58 |
| 5,890,387 | A * | 4/1999 | Roper et al. | 72/58 |
| 7,266,982 | B1 * | 9/2007 | Guza | 72/60 |
| 7,269,986 | B2 * | 9/2007 | Pfaffmann et al. | 72/60 |
| 7,464,572 | B2 * | 12/2008 | Miyanaga et al. | 72/58 |

FOREIGN PATENT DOCUMENTS

| | | |
|---|---|---|
| DE | 103 93 208 T5 | 11/2005 |
| EP | 0 588 528 | 3/1994 |
| JP | 6-292929 | 10/1994 |
| JP | 10-156429 | 6/1998 |
| JP | 2001-150048 | 6/2001 |
| JP | 2002-096118 | 4/2002 |
| JP | 2003-290845 | 10/2003 |
| JP | 2003-290850 | 10/2003 |
| JP | 2004-105995 | 4/2004 |
| JP | 2005-324209 | 11/2005 |
| WO | 2004/024359 A2 | 3/2004 |

* cited by examiner

*Primary Examiner*—David B Jones
(74) *Attorney, Agent, or Firm*—Rankin, Hill & Clark LLP

(57) ABSTRACT

A bulging apparatus has a heating station, a tube expanding station, a preforming station, and a main forming station. A straight tube as a workpiece is gripped by first holding mechanisms or second holding mechanisms, and delivered between the stations as the first holding mechanisms or second holding mechanisms are displaced. During a preforming process and a main holding process, both the first holding mechanisms and second holding mechanisms can be lifted and lowered vertically and can be moved horizontally.

16 Claims, 16 Drawing Sheets

BULGING METHOD AND APPARATUS

TECHNICAL FIELD

The present invention relates to a bulging method for performing a forming process on a hollow member by introducing a fluid under pressure thereinto, and an apparatus for carrying out such a bulging method.

BACKGROUND ART

Bulging processes have been employed to produce hollow formed bodies which are long and whose cross-sectional shapes and dimensions perpendicular to the longitudinal direction thereof differ from position to position (see, for example, Patent Document 1). As described in Patent Documents 2, 3, bulging apparatus for performing bulging processes have a single compressing mechanism that is combined with interchangeable dies. The bulging apparatus have a plurality of dies each interchangeable with another die suitable for a shape to be formed.

A bulging process using a straight tube as a blank workpiece will specifically be described below. First, the straight tube is gripped and placed in a die. Then, a fluid under pressure (generally water under high pressure) is supplied into the straight tube.

Therefore, the straight tube has its inner circumferential wall pressed by the fluid under pressure, and is expanded diametrically outwardly. As the straight tube is placed in the die, the expanded portion of the straight tube is finally stopped by the die. Therefore, the straight tube is formed into a shape corresponding to the cavity of the die. This process is also referred to as a tube expanding process.

Then, the die is removed from the compressing mechanism, and another die is mounted in the compressing mechanism for performing a next forming process. At this time, the die used in the tube expanding process is retracted from the compressing mechanism, and the die to be used in the forming process is moved to the compressing mechanism.

The expanded straight tube is transferred to the die, and then compressed to a predetermined shape by the compressing mechanism. A final formed product is now obtained.

Patent Document 1: Japanese Laid-Open Patent Publication No. 2002-96118

Patent Document 2: Japanese Laid-Open Patent Publication No. 10-156429

Patent Document 3: Japanese Laid-Open Patent Publication No. 2001-150048

DISCLOSURE OF THE INVENTION

As can be understood from the foregoing, it has heretofore been customary to move dies to replace one with the other in the bulging process. However, since it takes a long time to move the heavy dies, the cycle time for producing a final formed product from a straight tube is long.

Furthermore, it is not easy to form a complexly shaped product such as a frame for an automobile body or the like only in two processes, i.e., the tube expanding process and the final forming process. It has been considered to perform a preforming process after the tube expanding process. However, using three interchangeable dies on one compressing mechanism tends to make the apparatus complicated in structure. It is not easy to install the three dies movably on the compressing mechanism. Even if the three dies are installed movably on the compressing mechanism, a wide space is required.

In order to avoid the above drawbacks, it may be proposed to prepare individually a die for performing the tube expanding process, a die for performing the preforming process, and a die for performing the finally forming process, and to deliver a workpiece to the dies with a robot. However, since the robot is needed, the apparatus is complex in structure and the investment for facilities is high.

It is a general object of the present invention to provide a bulging process which is capable of shortening a cycle time.

A major object of the present invention is to provide a bulging apparatus which is simple in structure even though it has two or more dies.

Another object of the present invention is to provide a bulging apparatus which makes it difficult for a hollow member being formed to be deformed.

According to an aspect of the present invention, a bulging method for performing a forming process on a hollow member by introducing a fluid under pressure thereinto, comprises the steps of:

gripping the hollow member at opposite ends thereof with rods, which are movable back and forth, of first holding mechanisms, with fluid pressure passages defined in the rods;

introducing a fluid under pressure into the hollow member gripped by the rods to expand the hollow member, and stopping the hollow member with a tube expanding die;

displacing the first holding mechanisms from the tube expanding die to a preforming die with displacing mechanisms to deliver the expanded hollow member to the preforming die;

preforming the hollow member with the preforming die; and gripping the hollow member at the opposite ends thereof with rods, which are movable back and forth, of second holding mechanisms, with fluid pressure passages defined in the rods, displacing the second holding mechanisms from the preforming die to a main forming die with displacing mechanisms to deliver the preformed hollow member to the main forming die; and forming the hollow member into a product shape with the main forming die.

According to the present invention, the hollow member (workpiece) gripped by the holding mechanisms is delivered between the dies. Stated otherwise, not the dies which are heavy, but the workpiece is delivered together with the holding mechanisms. Since the workpiece is much smaller and lighter than the dies, it can be delivered with utmost ease. Therefore, the cycle time required until a final formed product is shortened. According to the present invention, therefore, the efficiency of the bulging process is greatly increased.

As the bulging apparatus has two sets of holding mechanisms, two workpieces can simultaneously be formed. Consequently, the efficiency of the bulging process is made much higher.

Furthermore, there is no need for a mechanism for moving the dies. Therefore, the apparatus is much simpler in structure.

A set of holding mechanisms may be employed. Specifically, according to another aspect of the present invention, a bulging method for performing a forming process on a hollow member by introducing a fluid under pressure thereinto, comprises the steps of:

gripping the hollow member at opposite ends thereof with rods, which are movable back and forth, of holding mechanisms, with fluid pressure passages defined in the rods;

introducing a fluid under pressure into the hollow member gripped by the rods to expand the hollow member, and stopping the hollow member with a tube expanding die;

displacing the holding mechanisms from the tube expanding die to a main forming die with displacing mechanisms to deliver the expanded hollow member to the main forming die; and forming the hollow member into a product shape with the main forming die.

In the above bulging method, since the workpiece gripped by the holding mechanisms is delivered between the dies, there is no need to move the dies, and the efficiency of the bulging process is greatly increased.

A preforming die may be disposed between the tube expanding die and the main forming die for preforming the workpiece.

If the workpiece is preformed, then the hollow member is mainly formed by the main forming die after the preformed hollow member is angularly moved. It is thus possible to obtain a finally finished product having a desired shape.

The fluid supplied under pressure to the hollow member should preferably a compressed gas. A compressed gas supply mechanism is smaller in size than a high-pressure liquid supply mechanism. Therefore, the investment for facilities is lower, and the installation space is smaller.

When the hollow member is preformed or mainly formed, the hollow member should preferably be supported so as to be translatable in either a vertical direction or a horizontal direction. The hollow member thus supported is prevented from being deformed, so that the final formed product can be produced with excellent dimensional accuracy.

When the hollow member is heated while being held by the rods, the hollow member clamped by a heating unit is prevented from flexing by being pressed by the heating unit.

According to still another aspect of the present invention, a bulging apparatus for performing a forming process on a hollow member by introducing a fluid under pressure thereinto, comprises:

first holding mechanisms and second holding mechanisms having rods for gripping the hollow member at opposite ends thereof, the rods being movable back and forth, with fluid pressure passages defined in the rods;

a tube expanding die for stopping the hollow member which is gripped by the rods, while the hollow member is being expanded by a fluid under pressure being introduced thereinto;

a preforming die for preforming the expanded hollow member;

a main forming die for forming the preformed hollow member into a product shape; and displacing mechanisms for displacing the first holding mechanisms from the tube expanding die to the preforming die or from the preforming die to the tube expanding die, and displacing the second holding mechanisms from the preforming die to the main forming die or from the main forming die to the preforming die;

wherein the first holding mechanisms and the second holding mechanisms are displaced by the displacing mechanisms to deliver the hollow member gripped by the rods of the first holding mechanisms from the tube expanding die to the preforming die and to deliver the hollow member gripped by the rods of the second holding mechanisms from the preforming die to the main forming die.

As the preforming die and the two sets of holding mechanisms are provided, two workpieces can simultaneously be formed. Therefore, a final forming product can efficiently be produced. Stated otherwise, the efficiency of the bulging process is greatly increased.

According to yet another aspect of the present invention, a bulging apparatus for performing a forming process on a hollow member by introducing a fluid under pressure thereinto, comprising:

holding mechanisms having rods for gripping the hollow member at opposite ends thereof, the rods being movable back and forth, with fluid pressure passages defined in the rods;

a tube expanding die for stopping the hollow member which is gripped by the rods, while the hollow member is being expanded by a fluid under pressure being introduced thereinto;

a main forming die for forming the expanded hollow member into a product shape; and displacing mechanisms for displacing the holding mechanisms from the tube expanding die to the main forming die or from the main forming die to the tube expanding die;

wherein the holding mechanisms are displaced by the displacing mechanisms to deliver the hollow member gripped by the rods from the tube expanding die to the main forming die.

With the above arrangement, the dies are not moved, but the hollow member is moved and formed. Therefore, the bulging apparatus is simple in structure.

A preforming die may be disposed between the tube expanding die and the main forming die, for preforming the expanded hollow member. Since the hollow member can be deformed stepwise, it can be machined more easily than it is greatly deformed once.

Either of the above bulging apparatus should preferably have turning mechanisms for angularly moving the holding mechanisms to make it easy to produce a final formed product having a desired shape.

For the reasons described above, the fluid introduced under pressure into the rods and the hollow member should preferably be a compressed gas. The bulging apparatus is thus combined with a compressed gas supply facility. It is preferable to provide a heating unit for heating the hollow member to be delivered to the tube expanding die in order to increase the deformability of the hollow tube.

When the hollow member is formed by the main forming die, the rods should preferably be translatable in at least one of vertical directions and horizontal directions, or most preferably be translatable in both vertical directions and horizontal directions. The hollow member is thus prevented from being deformed into shapes other than a predetermined shape, and can be processed into a final formed product with excellent dimensional accuracy.

BEST MODE FOR CARRYING OUT THE INVENTION

Bulging methods according to preferred embodiments will be described in detail below in relation to forming apparatus for carrying out the bulging methods with reference to the accompanying drawings.

Figure 1:
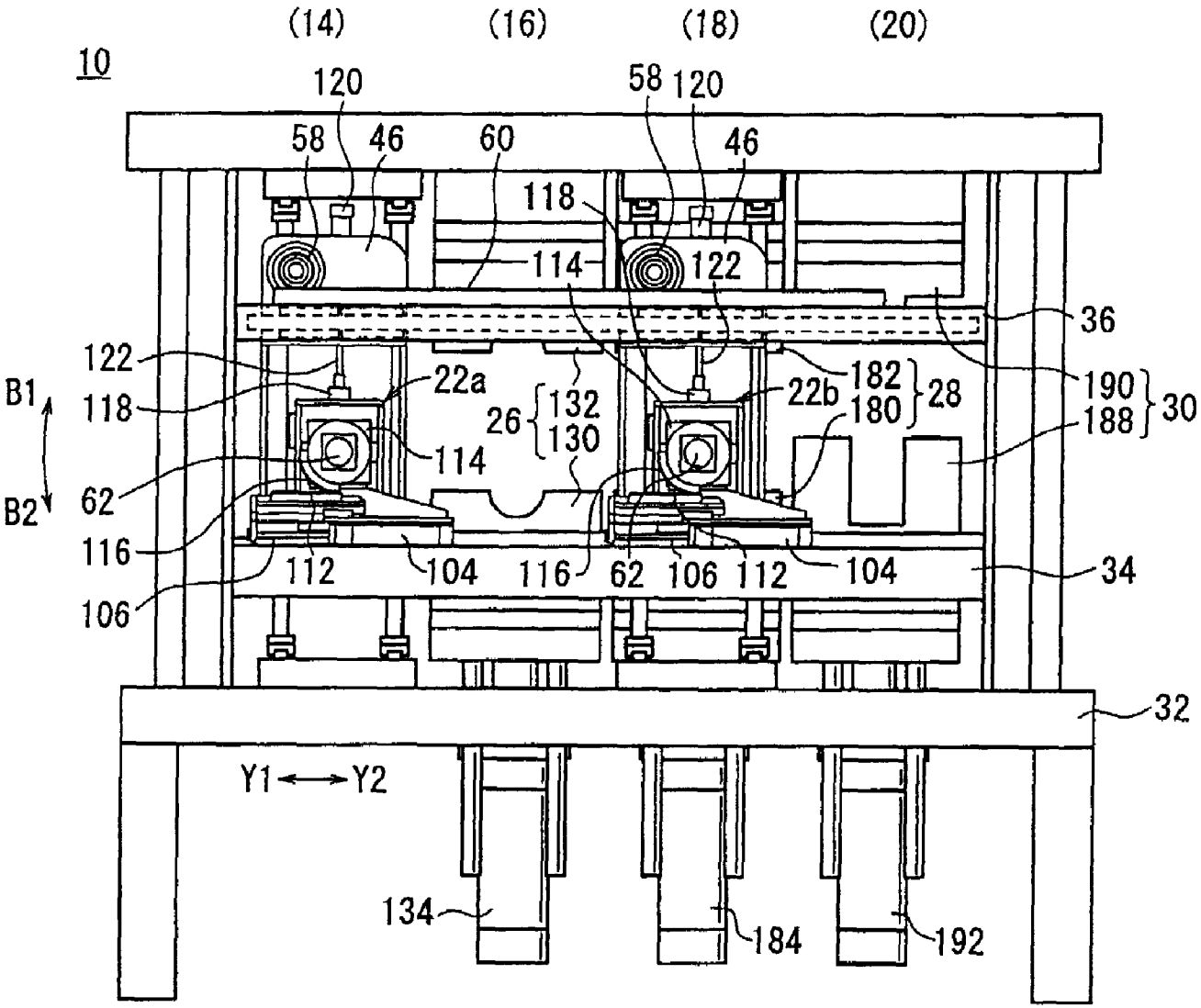
FIG. 1 is a schematic front elevational view of a bulging apparatus according to a first embodiment.
Figure 2:
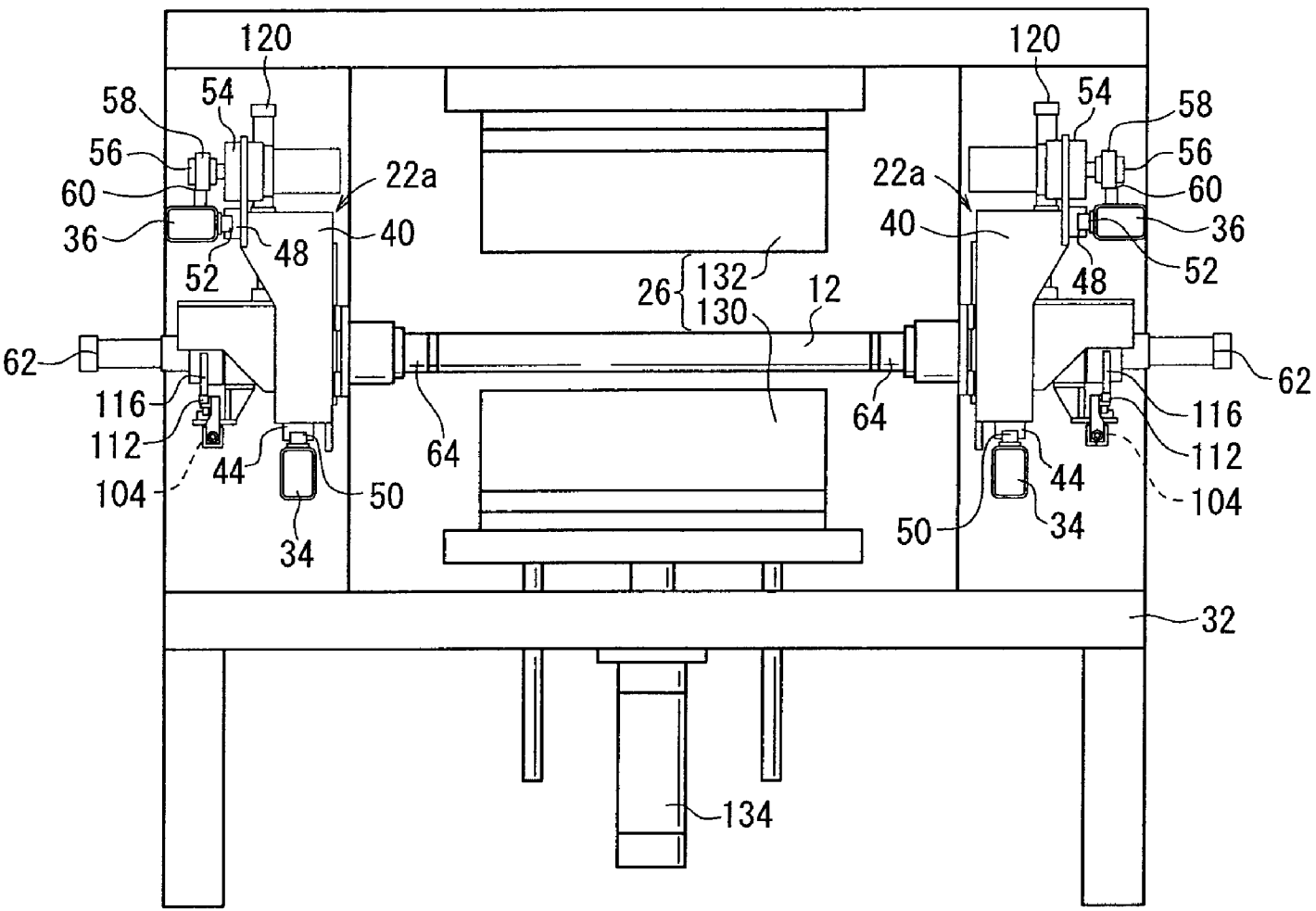
FIG. 2 is a schematic side elevational view of the bulging apparatus shown in FIG. 1.
Figure 3:
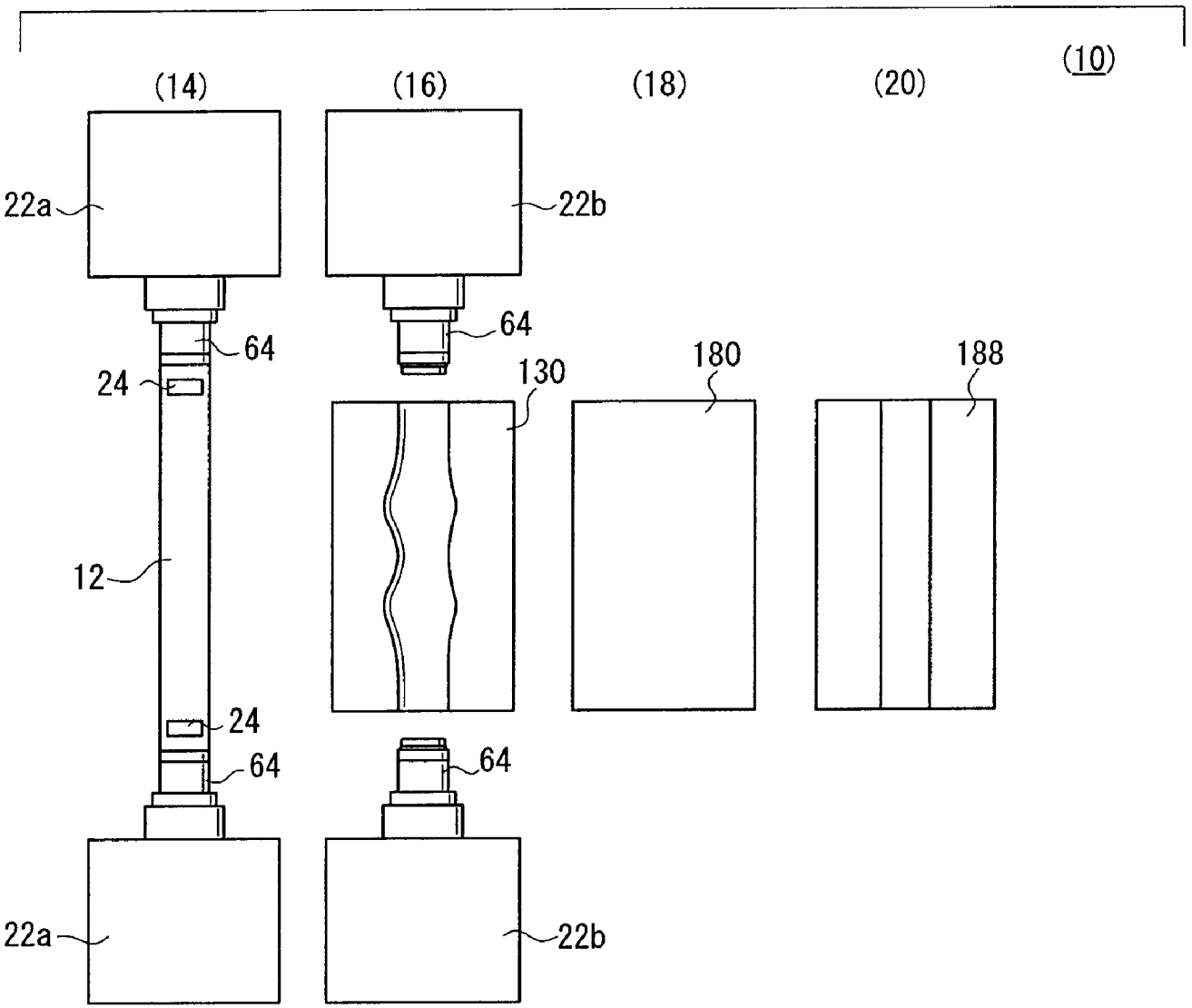
FIG. 3 is a plan view schematically showing, from above, the bulging apparatus shown in FIG. 1.

FIGS. 1 and 2 are a schematic front elevational view and a schematic side elevational view, respectively, of a bulging apparatus 10 according to a first embodiment, and FIG. 3 is a plan view schematically showing, from above, the bulging apparatus 10.

As can be understood from FIGS. 1 and 3, the bulging apparatus 10 has a heating station 14 for performing induction heating on a workpiece 12 (hollow member), a tube expanding station 16 for expanding the heated workpiece 12 by introducing a compressed gas thereinto, a preforming station 18 for preforming the expanded workpiece 12, and a main forming station 20 for performing a main forming process on the preformed workpiece 12. As described later, the workpiece 12 is gripped at its opposite ends by a set of first holding mechanisms 22*a*, 22*a* and fed between the stations 14, 16, and gripped at its opposite ends by a set of second holding mechanisms 22*b*, 22*b* and fed between the stations 18, 20.

Heating electrodes 24 (see FIG. 3) as heating units are disposed in the heating station 14, and a tube expanding die 26 for expanding the workpiece, a preforming die 28 for preforming the workpiece, and a main forming die 30 for performing the main forming process are disposed respectively in the tube expanding station 16, the preforming station 18, and the main forming station 20 (see FIG. 1).

The bulging apparatus 10 has a main frame 32, and includes a lower auxiliary frame 34 and an upper auxiliary frame 36 which extend from the heating station 14 to the main forming station 20. As described later, the first and second holding mechanisms 22*a*, 22*b* are displaceable along the lower auxiliary frame 34 and the upper auxiliary frame 36.

The workpiece 12 gripped by the first holding mechanisms 22*a*, 22*a* in the heating station 14 is delivered to the tube expanding station 16, the preforming station 18, and the main forming station 20 as the first holding mechanisms 22*a*, 22*a* and the second holding mechanisms 22*b*, 22*b* which subsequently grip the workpiece 12 are displaced successively to the tube expanding die 26, the preforming die 28, and the main forming die 30.

Figure 4:
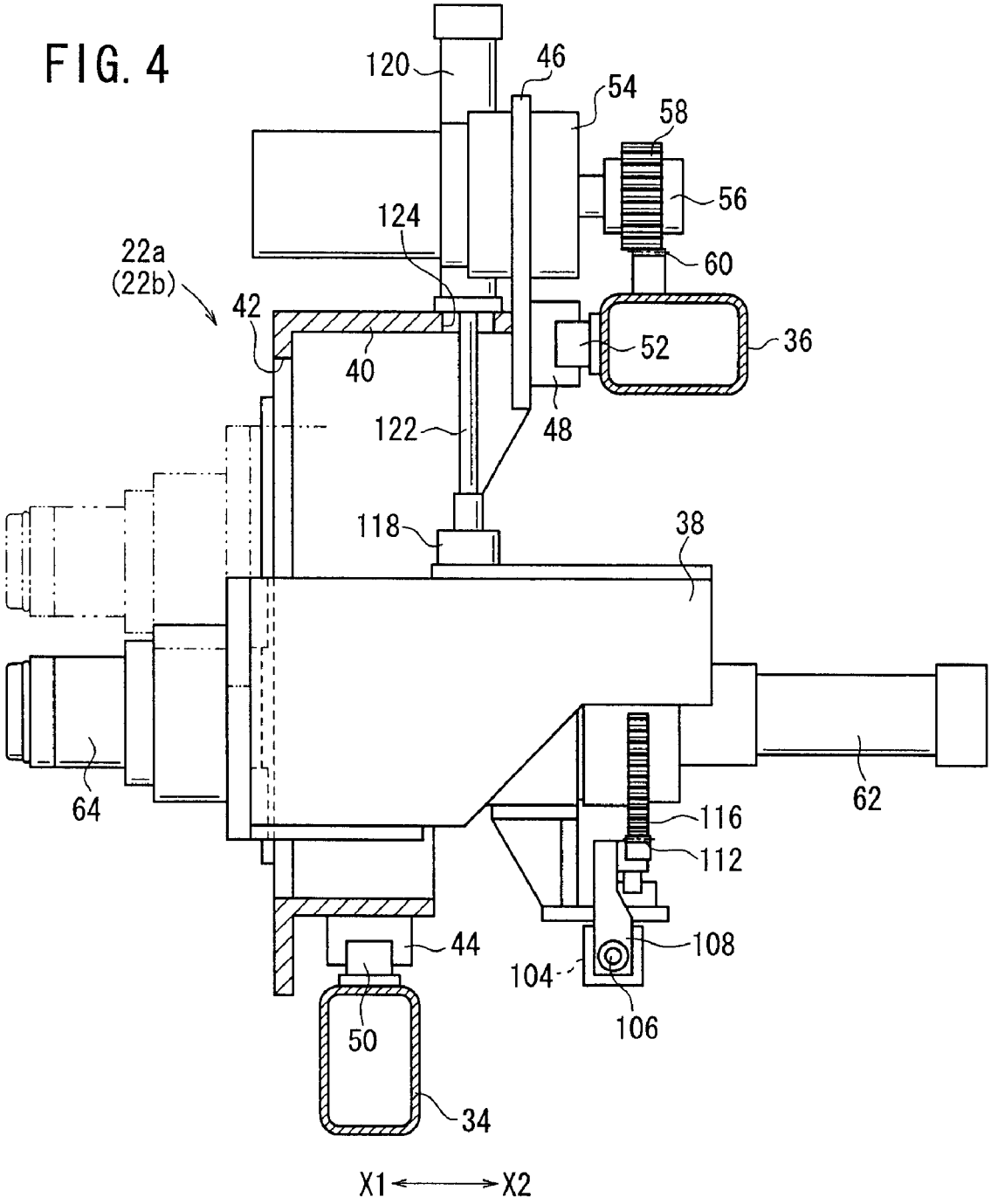
FIG. 4 is a schematic view of a holding mechanism of the bulging apparatus shown in FIG. 1.

As shown in FIG. 4, each of the first holding mechanisms 22*a* has a body 38 extending from an open end of a holder 40 into a hole 42 defined in the other end thereof. The holder 40 has a lower end surface and an upper side surface on which a first engaging member 44 and a side plate 46 are mounted, respectively, with a second engaging member 48 being mounted on the side plate 46. The first engaging member 44 and the second engaging member 48 are held in slidable engagement with guide rails 50, 52, respectively, that are laid on the lower auxiliary frame 34 and the upper auxiliary frame 36, respectively.

Figure 5:
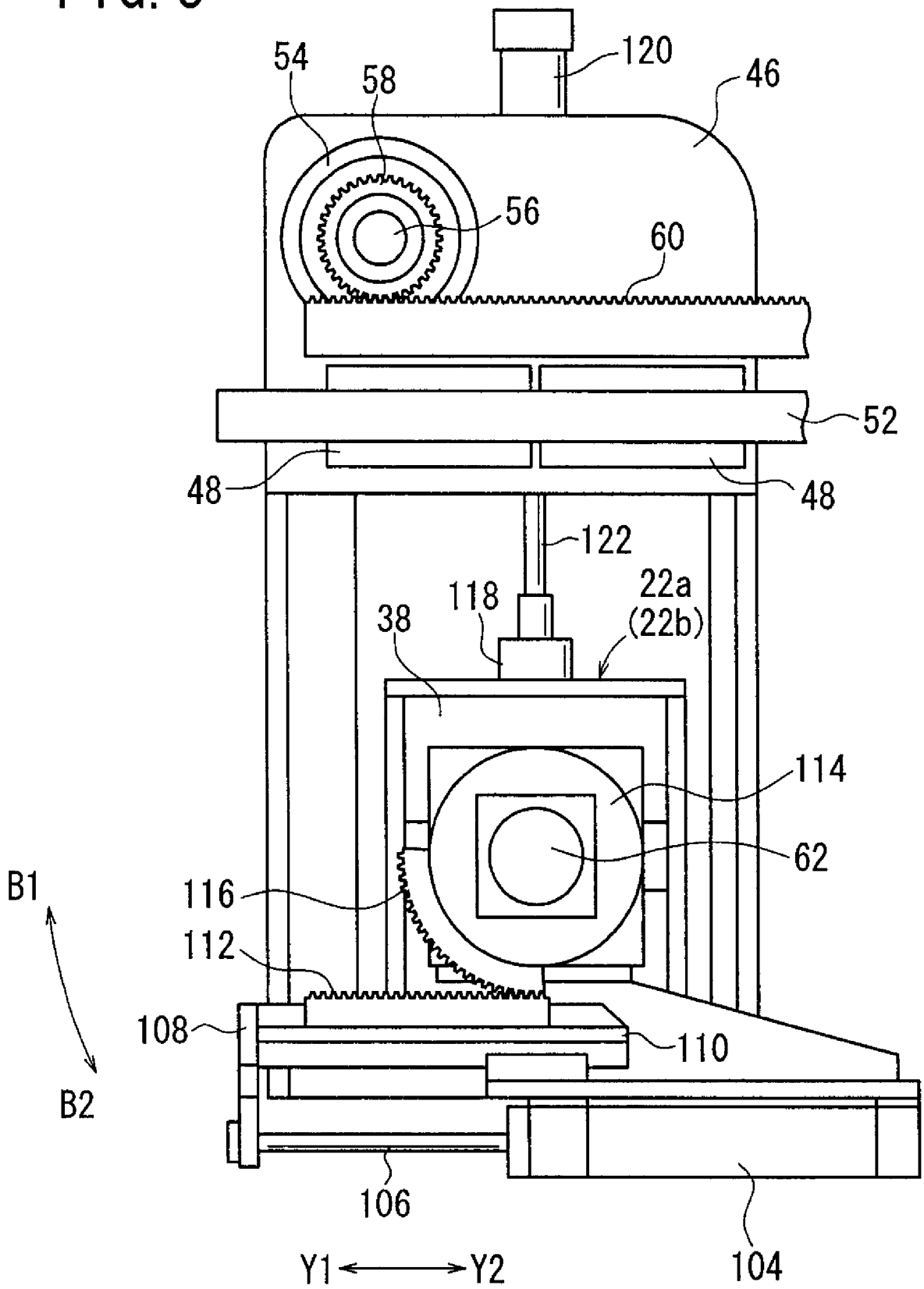
FIG. 5 is a schematic front elevational view of the holding mechanism shown in FIG. 4.

A servomotor 54 serving as a displacing mechanism is fixedly mounted on the side plate 46. As shown in FIGS. 1 and 5, the servomotor 54 has a rotational shaft 56 over which a first pinion 58 is fitted. A first rack 60 is mounted on an upper end surface of the upper auxiliary frame 36, and the first pinion 58 is held in mesh with the first rack 60.

As shown in FIG. 4, a workpiece gripping cylinder 62 is mounted on an end of the body 38. The workpiece gripping cylinder 62 has a rod 64 projecting from the hole 42 defined in the other end of the body 38 and movable back and forth in the directions indicated by the arrows X1, X2 in FIG. 4. The rod 64 has a compressed air passage, not shown, defined therein.

The body 38 is angularly movable 90° by a body turning cylinder 104 serving as a turning mechanism. As shown in FIGS. 1, 4, and 5, the body turning cylinder 104 is disposed beneath the body 38 and has a rod 106 to which there is coupled a driven rod 110 extending parallel to the body turning cylinder 104 by a coupling member 108. A second rack 112 is mounted on the driven rod 110. An arcuate second pinion 116 held in mesh with the second rack 112 is fixedly mounted on a peripheral side wall of a tubular member 114 of the body 38. When the rod 106 of the body turning cylinder 104 is moved back and forth in the directions indicated by the arrows Y1, Y2 in FIG. 5, the tubular member 114 and the body 38 are angularly moved in the directions indicated by the arrows B1, B2.

A bracket 118 is mounted on an upper portion of the body 38 (see FIG. 4), and a rod 122 of a body lifting/lowering cylinder 120 serving as a lifting/lowering mechanism has a distal end housed in the bracket 118 with play. Specifically, the distal end of the rod 122 is so wide that it is prevented from being removed from the bracket 118. The rod 122 lifts and lowers the body 38 indirectly through the bracket 118.

The body lifting/lowering cylinder 120 is mounted on an upper end surface of the holder 40, and the rod 122 extends through a passage hole 124 defined in the upper end surface of the holder 40. Stated otherwise, the body lifting/lowering cylinder 120 is inverted and fixedly positioned on the upper end surface of the holder 40.

Each of the second holding mechanisms 22*b* is of an identical construction (see FIG. 2). Therefore, identical parts are denoted by identical reference characters, and will not be described in detail below.

The heating electrodes 24 shown in FIG. 3 are disposed in the heating station 14. Each of the heating electrodes 24 is movable toward and away from the workpiece 12. The lower heating electrodes 24 and the upper heating electrodes 24 are disposed in positions confronting each other across the workpiece 12, so that the workpiece 12 is heated in its entirety by the four heating electrodes 24.

Figure 6:
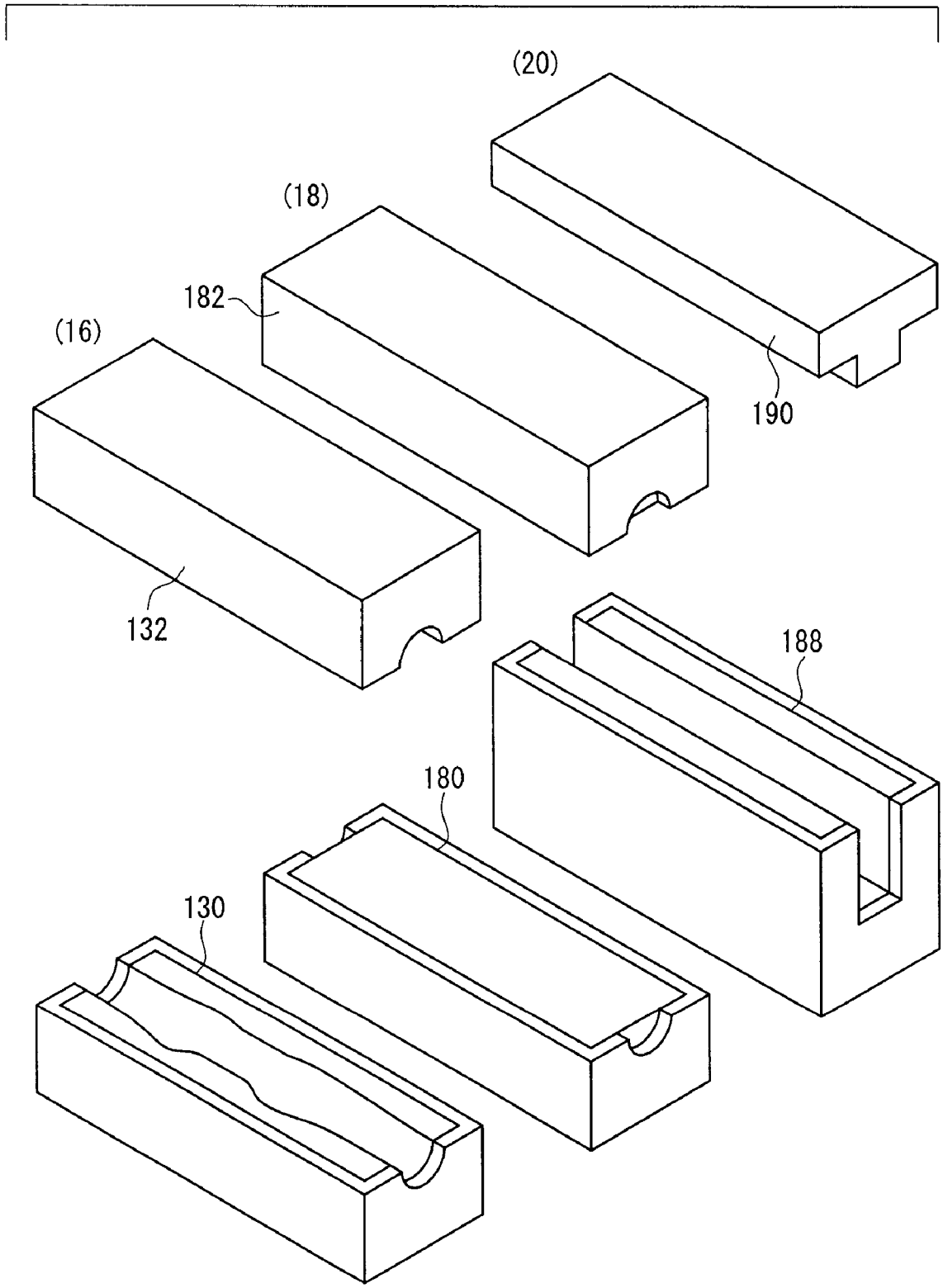
FIG. 6 is a schematic view of a plurality of dies of the bulging apparatus shown in FIG. 1.

The tube expanding station 16, the preforming station 18, and the main forming station 20, which are disposed parallel to the heating station 14, have the tube expanding die 26 for expanding the workpiece, the preforming die 28 for preforming the workpiece, and the main forming die 30 for performing the main forming process, disposed respectively therein (see FIG. 3). As shown in FIGS. 2 and 6, the tube expanding die 26 has a first lower die 130 and a first upper die 132. A first lower die cylinder 134 is supported on the main frame 32 and has a rod connected to the first lower die 130 (see FIG. 1). The first lower die 130 is thus vertically displaceable by the first lower die cylinder 134.

The preforming die 28 in the preforming station 18 and the main forming die 30 in the main forming station 20 are constructed essentially identically to the tube expanding die 26. Specifically, as shown in FIGS. 1 and 6, the preforming die 28 has a second lower die 180 and a second upper die 182. A second lower die cylinder 184 is supported on the main frame 32 and has a rod connected to the second lower die 180. Similarly, the main forming die 30 has a third lower die 188 and a third upper die 190. A third lower die cylinder 192 has a rod connected to the third lower die 188. The second lower die 180 and the third lower die 188 are vertically displaceable by the cylinders 184, 192 (see FIG. 1).

The upper dies 132, 182, 190 are fixedly positioned on the main frame 32. The dies 130, 132, 180, 182, 188, 190 are heated to predetermined temperatures by heating means, not shown.

The bulging apparatus 10 according to the first embodiment is basically constructed as described above. Operation and advantages of the bulging apparatus 10 will be described below with respect to a bulging process for forming a straight tube of aluminum alloy. In the description which follows, the straight tube will be denoted by the reference character 12 that has been used to denote the workpiece.

As shown in FIG. 3, for example, the first and second holding mechanisms 22*a*, 22*b* are disposed respectively in the heating station 14 and the tube expanding station 16. After the straight tube 12 is delivered to the heating station 14, the straight tube 12 is gripped by the first holding mechanisms 22*a*, 22*a*.

The heating electrodes 24 (see FIG. 3) are energized for heating and moved toward the straight tube 12. Finally, the heating electrodes 24 have their distal ends brought into abutment against the peripheral side wall of the straight tube 12 to heat the straight tube 12.

The straight tube 12 is thermally expanded as it is heated to about 450° to 550° C. That is, the longitudinal dimension of the straight tube 12 becomes large. According to the first embodiment, the distal ends of the heating electrodes 24 are held in abutment against the straight tube 12 while the heating electrodes 24 are displaceable in the longitudinal directions of the straight tube 12. Therefore, as the straight tube 12 is longitudinally elongated by thermal expansion, the heating electrodes 24 are displaced along the longitudinal directions of the straight tube 12. Consequently, even when the straight tube 12 is thermally expanded, the regions of the straight tube 12 that are clamped by the heating electrodes 24 are prevented from buckling.

The straight tube 12 thus heated is delivered to the tube expanding station 16 (see FIGS. 1 and 3) when the first holding mechanisms 22*a* are displaced. Specifically, the body lifting/lowering cylinders 120 (see FIG. 4) are actuated to retract the rods 122 thereof. As a result, the brackets 118 are pulled by the rods 122, lifting the bodies 38.

Then, the servomotors 54 are energized to start rotating the rotational shafts 56. The first pinions 58 which are rotated by the rotational shafts 56 roll in mesh with the first racks 60, and, as a result, the first holding mechanisms 22*a* start being displaced toward the tube expanding station 16. At this time, the first holding mechanisms 22*a* are guided by the guide rails 50, 52 mounted on the lower auxiliary frames 34 and the upper auxiliary frames 36.

When the first holding mechanisms 22*a* reach the tube expanding station 16, the servomotors 54 are de-energized, and the first pinions 58 stop rolling in mesh with the first racks 60 and the first holding mechanisms 22*a* stop being displaced. The body lifting/lowering cylinders 120 are actuated to expand the rods 122 to lower the first holding mechanisms 22*a* until finally the straight tube 12 is positioned between the first lower die 130 and the first upper die 132. The first lower die 130 and the first upper die 132 have been heated to a predetermined temperature by the heating means, not shown.

Figure 7:
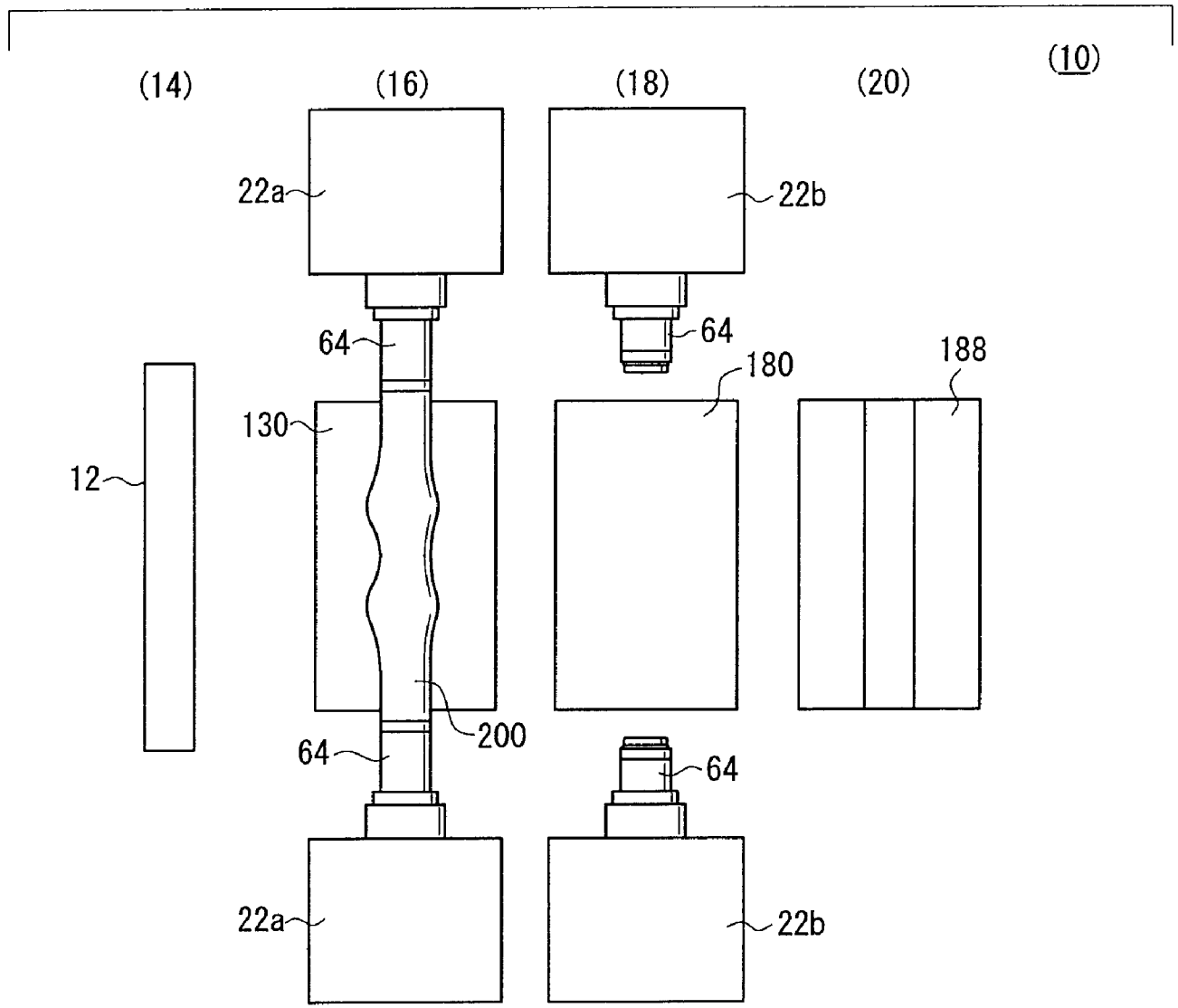
FIG. 7 is a schematic plan view showing the manner in which a first workpiece is expanded and a second workpiece is disposed in a heating station.

As the first holding mechanisms 22*a* are displaced to the tube expanding station 16, the second holding mechanisms 22*b* disposed in the tube expanding station 16 are displaced to the preforming station 18 (see FIG. 7). On the other hand, a second straight tube 12 is provided in the heating station 14.

Figure 8:
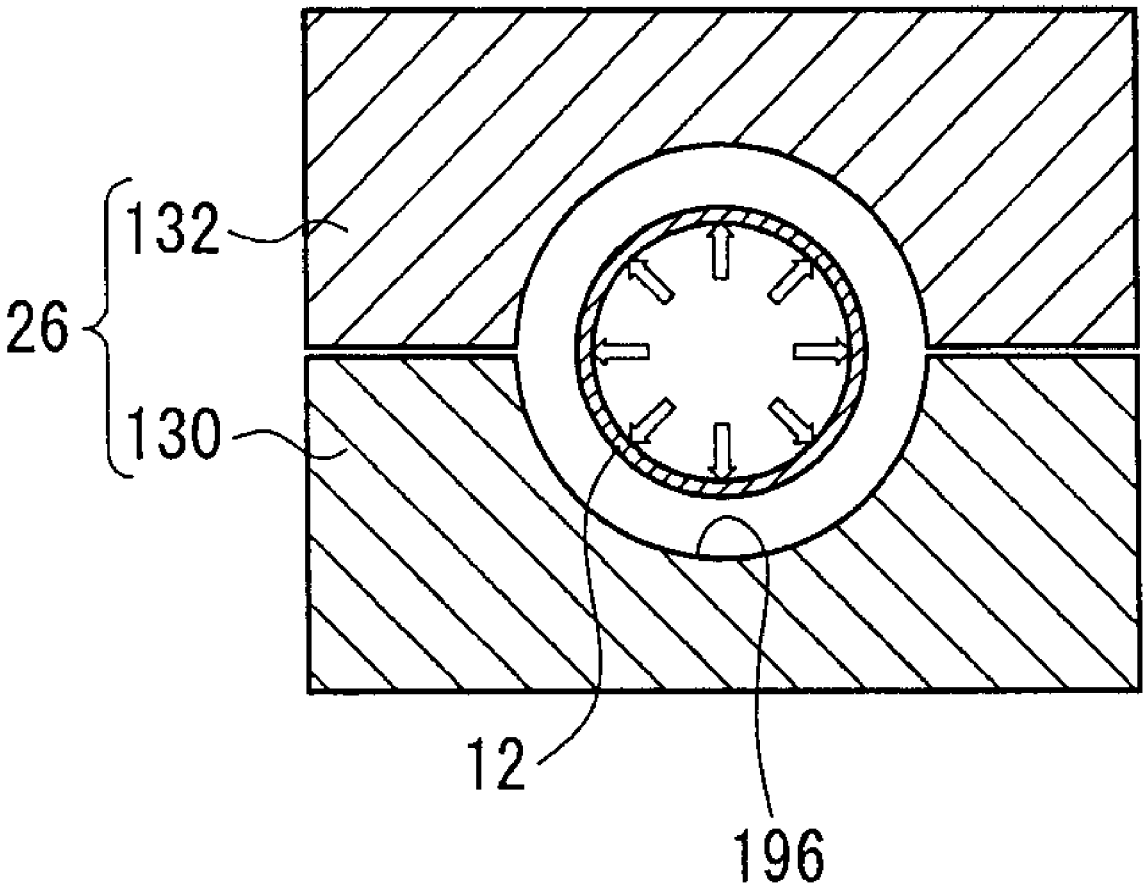
FIG. 8 is a schematic vertical cross-sectional view showing the manner in which a straight tube is expanded by a first lower die and a first upper die.

Thereafter, the first lower die cylinder 134 is actuated to lift the first lower die 130 toward the straight tube 12. The die is closed, and, as shown in FIG. 8, the straight tube 12 is placed in a cavity 196 defined by the first lower die 130 and the first upper die 132. The cavity 196 have some dimensions greater than the straight tube 12 such that the peripheral side wall of the straight tube 12 has portions spaced from both the first lower die 130 and the first upper die 132.

Then, compressed air is supplied through the compressed air passages in the rods 64 into the straight tube 12, developing a pressure buildup in the straight tube 12. Specifically, the straight tube 12 is pressed from inside thereof by the compressed air, forcing the portions of the straight tube 12 which are spaced from the first lower die 130 and the first upper die 132 to start expanding toward the first lower die 130 and the first upper die 132.

The expanded portions are finally stopped by the first lower die 130 and the first upper die 132. The expansion is stopped, thereby forming a first partly finished product 200 that is shaped complementarily to the cavity 196, as shown in FIG. 7.

While the straight tube 12 is being thus expanded, since the first lower die 130 and the first upper die 132 is being heated by the heating means, the temperature of the straight tube 12 is prevented from being lowered.

If the straight tube 12 is expanded without its longitudinal dimension remaining unchanged, then the wall thickness of the straight tube 12 is reduced. In order to prevent the wall thickness of the straight tube 12 from being reduced, the rods 64 are moved forward as the straight tube 12 is expanded. Therefore, the wall thickness of the first partly finished product 200 is not reduced.

Upon elapse of a predetermined time after the die is closed, the compressed air is discharged through the compressed air passages in the rods 64. The first lower die 130 is lowered to open the die, as shown in FIG. 7.

Figure 9:
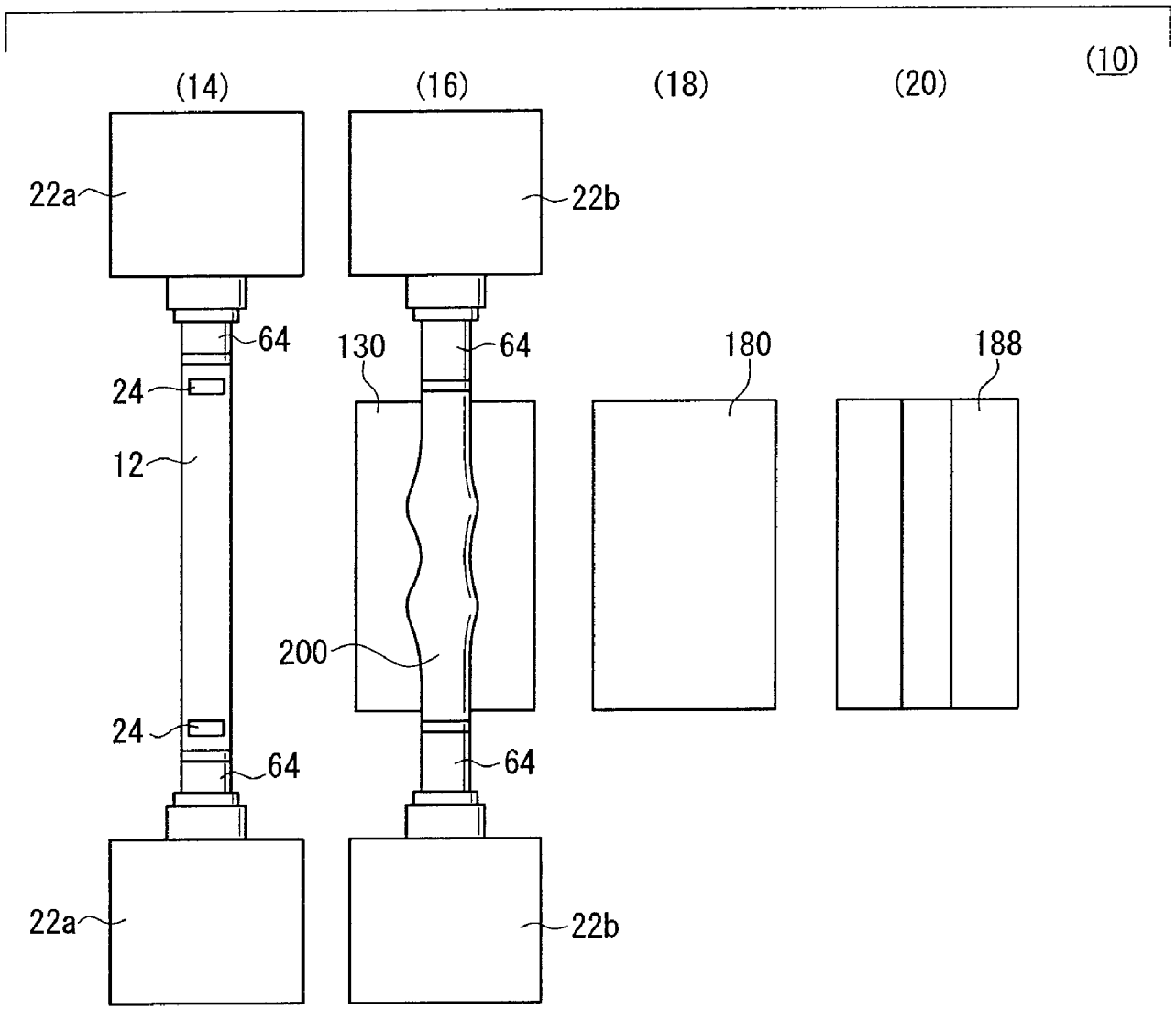
FIG. 9 is a schematic plan view showing the manner in which the first workpiece that has been expanded is gripped by second holding mechanisms and the second workpiece is gripped by first holding mechanisms.

When the tube expanding process is finished, the first holding mechanisms 22*a*, 22*a* are retracted to release the first partly finished product 200. As shown in FIG. 9, the first holding mechanisms 22*a*, 22*a* returns to the heating station 14 and grip the second straight tube 12, and the second holding mechanisms 22*b*, 22*b* return to the tube expanding station 16 and grip the first partly finished product 200 (formed from the first straight tube 12).

Figure 10:
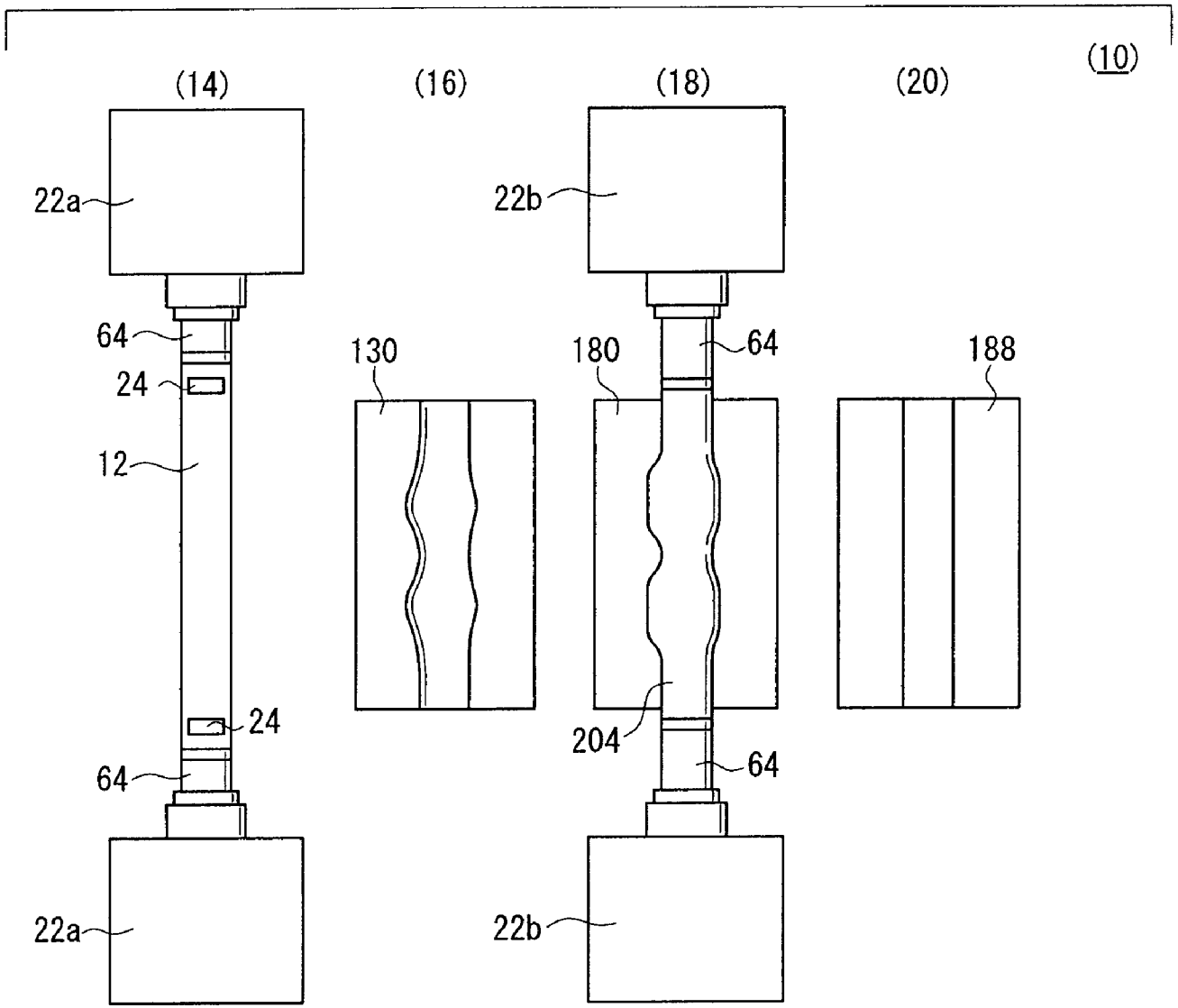
FIG. 10 is a schematic plan view showing the manner in which the first workpiece gripped by the second holding mechanisms is being preformed.

The first partly finished product 200 is delivered to the preforming station 18 in the same manner as the straight tube 12 is delivered from the heating station 14 to the tube expanding station 16 (see FIG. 10). Specifically, the body lifting/lowering cylinders 120 (see FIG. 4) of the second holding mechanisms 22*b* are actuated to lift the bodies 38, and then the servomotors 54 are energized to cause the first pinions 58 to roll on the first racks 60. The second holding mechanisms 22*b* are displaced toward the preforming station 18. At this time, the second holding mechanisms 22*b* are also guided by the guide rails 50, 52.

When the first partly finished product 200 is thus delivered, it is disposed between the second lower die 180 and the second upper die 182. Thereafter, the servomotors of the body lifting/lowering cylinders 120 are de-energized, bringing the body lifting/lowering cylinders 120 into a so-called servo-free state. When an external force is applied to the rods 122 of the body lifting/lowering cylinders 120, the rods 122 are moved back and forth by a displacement depending on the magnitude of the external force.

Then, only the second lower die cylinder 184 is actuated to elevate the second lower die 180 to press the first partly finished product 200 toward the second upper die 182.

Since the body lifting/lowering cylinders 120 are held in the servo-free state, the rods 64 of the second holding mechanisms 22*b* are lifted parallel to the vertical direction as indicated by the imaginary lines in FIG. 4 as the first partly finished product 200 is pressed by the second lower die 180.

As can be seen from the foregoing, even when the first partly finished product 200 is pressed upwardly, it receives no resistance from the body lifting/lowering cylinders 120. Therefore, the first partly finished product 200 can easily be brought closely to the second upper die 182. As the second holding mechanisms 22*b* are vertically displaceable, the pressed first partly finished product 200 is not released from the second holding mechanisms 22*b*. Consequently, no compressed air leaks from between the first partly finished product 200 and the second holding mechanisms 22*b*.

Immediately before the second lower die 180 abuts against the first partly finished product 200, compressed air is supplied from the compressed air passages in the rods 64. The pressure under which the compressed air is supplied may be set to a level not large enough to expand the first partly finished product 200.

Figure 11:
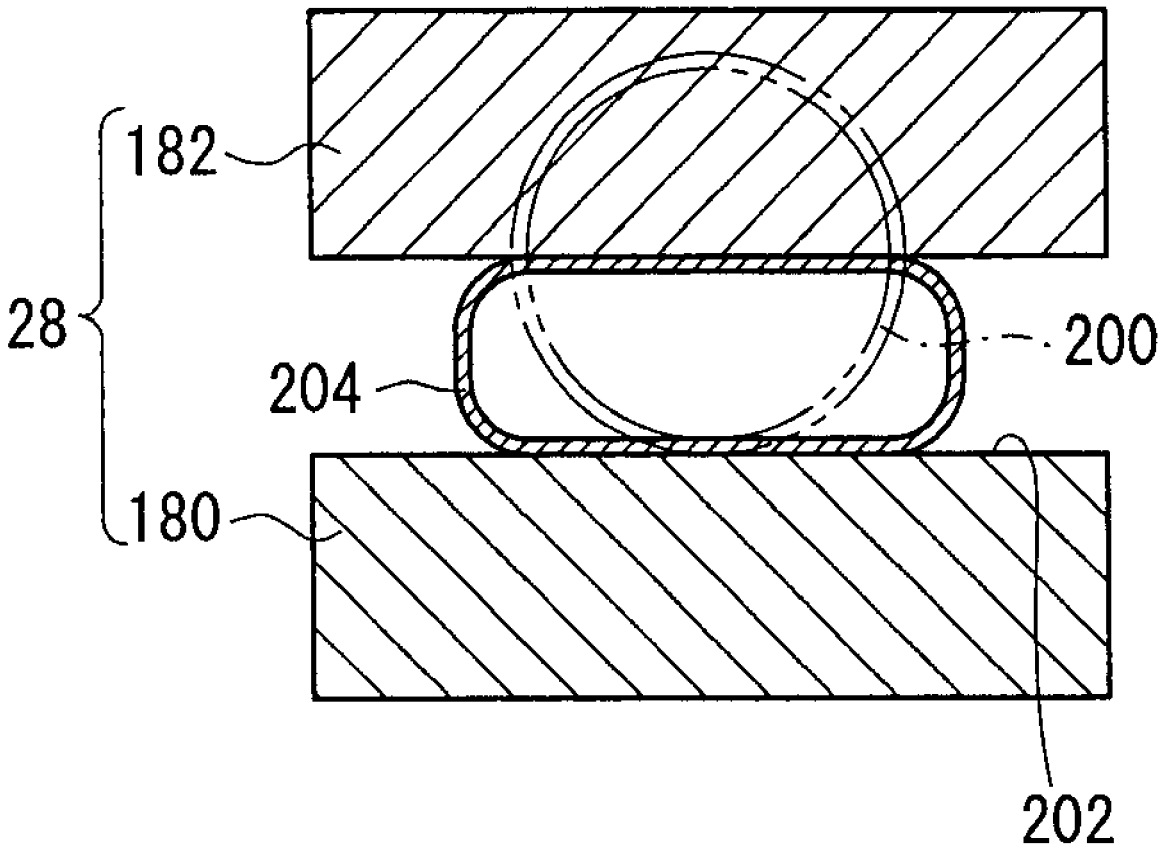
FIG. 11 is a schematic vertical cross-sectional view showing the manner in which a first partly finished product is preformed by a second lower die and a second upper die.

When the second lower die 180 abuts against the first partly finished product 200, a cavity 202 is defined as shown in FIG. 11. The first partly finished product 200 is partly squeezed into an elliptical cross-sectional shape, thereby producing a second partly finished product 204 shown in FIG. 10.

The squeezing (preforming) progresses as the second lower die 180 approaches the second upper die 182. During the squeezing, the servomotors 54 are in a servo-free state, i.e., the forces on the rotational shafts 56 of the servomotors 54 are reduced. Therefore, during the squeezing, the second holding mechanisms 22*b* are translatable in the direction (horizontal direction) in which the stations 14, 16, 18 are juxtaposed.

When the squeezing is finished, the compressed air is discharged, and the second lower die cylinder 184 is actuated to lower the second lower die 180. The die is opened, and since the body lifting/lowering cylinders 120 are held in the servo-free state, the second partly finished product 204 returns to its initial position.

While the preforming process is thus being performed to produce the second partly finished product 204 in the preforming station 18, the second straight tube 12 may continuously be heated in the heating station 14, as shown in FIG. 10.

The exposed second partly finished product 204 is then delivered to the main forming station 20 in the same manner as the first partly finished product 200 is delivered from the tube expanding station 16 to the preforming station 18. Specifically, the body lifting/lowering cylinders 120 (see FIG. 4) of the second holding mechanisms 22*b* are actuated to elevate the bodies 38 in the same manner as described above. Then, the servomotors 54 are energized to cause the first pinions 58 to roll on the first racks 60. The second holding mechanisms 22*b* are displaced toward the main forming station 20 while being guided on the guide rails 50, 52.

Figure 12:
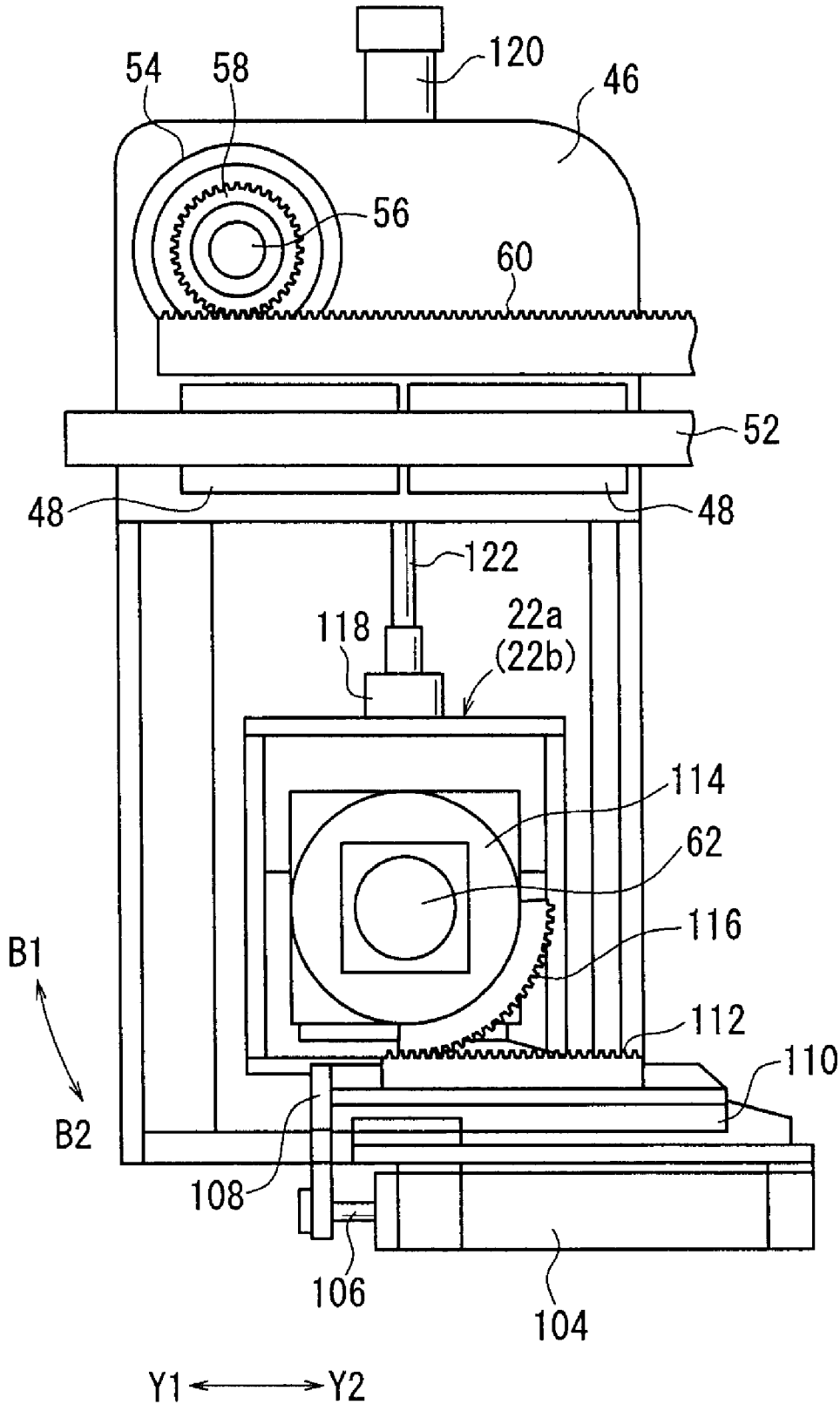
FIG. 12 is a schematic front elevational view of the holding mechanisms which have been angularly moved 90° from the position shown in FIG. 4.

During the delivery of the second partly finished product 204, the body turning cylinders 104 (see FIG. 5) are actuated. As shown in FIG. 12, when the rods 106 are retracted in the direction indicated by the arrow Y2, the driven rods 110 are retracted, and the second pinions 116 held in mesh with the second racks 112 are rotated 90° in the direction indicated by the arrow B2. Then, the body 38 and the second holding mechanism 22*b* are rotated 90° in the direction indicated by the arrow B2. The second partly finished product 204 is also angularly moved 90°. Specifically, upon completion of the preforming, the second partly finished product 204 includes a portion which is horizontally elongate elliptical cross-sectional shape (see FIG. 11). As the bodies 38 are rotated, the portion of the second partly finished product 204 becomes vertically elongate in its elliptical cross-sectional shape.

When the delivery of the second partly finished product 204 is finished, the second partly finished product 204 is placed between the third lower die 188 and the third upper die 190. Thereafter, the body lifting/lowering cylinders 120 are brought into a servo-free state in the same manner as described above.

Then, the third lower die cylinder 192 is actuated to lift the third lower die 188 to press the second partly finished product 204 toward the third upper die 190.

At this time, since the body lifting/lowering cylinders 120 are held in the servo-free state as with the preforming process, the rods 64 of the second holding mechanisms 22*b* are lifted parallel to the vertical direction as indicated by the imaginary lines in FIG. 4 as the second partly finished product 204 is pressed by the third lower die 188.

Consequently, the second partly finished product 204 can easily be brought closely to the third upper die 190. The second partly finished product 204 which is pressed by the third lower die 188 is not released from the rods 64.

Immediately before the third lower die 188 abuts against the second partly finished product 204, compressed air is supplied from the compressed air passages in the rods 64.

Figure 13:
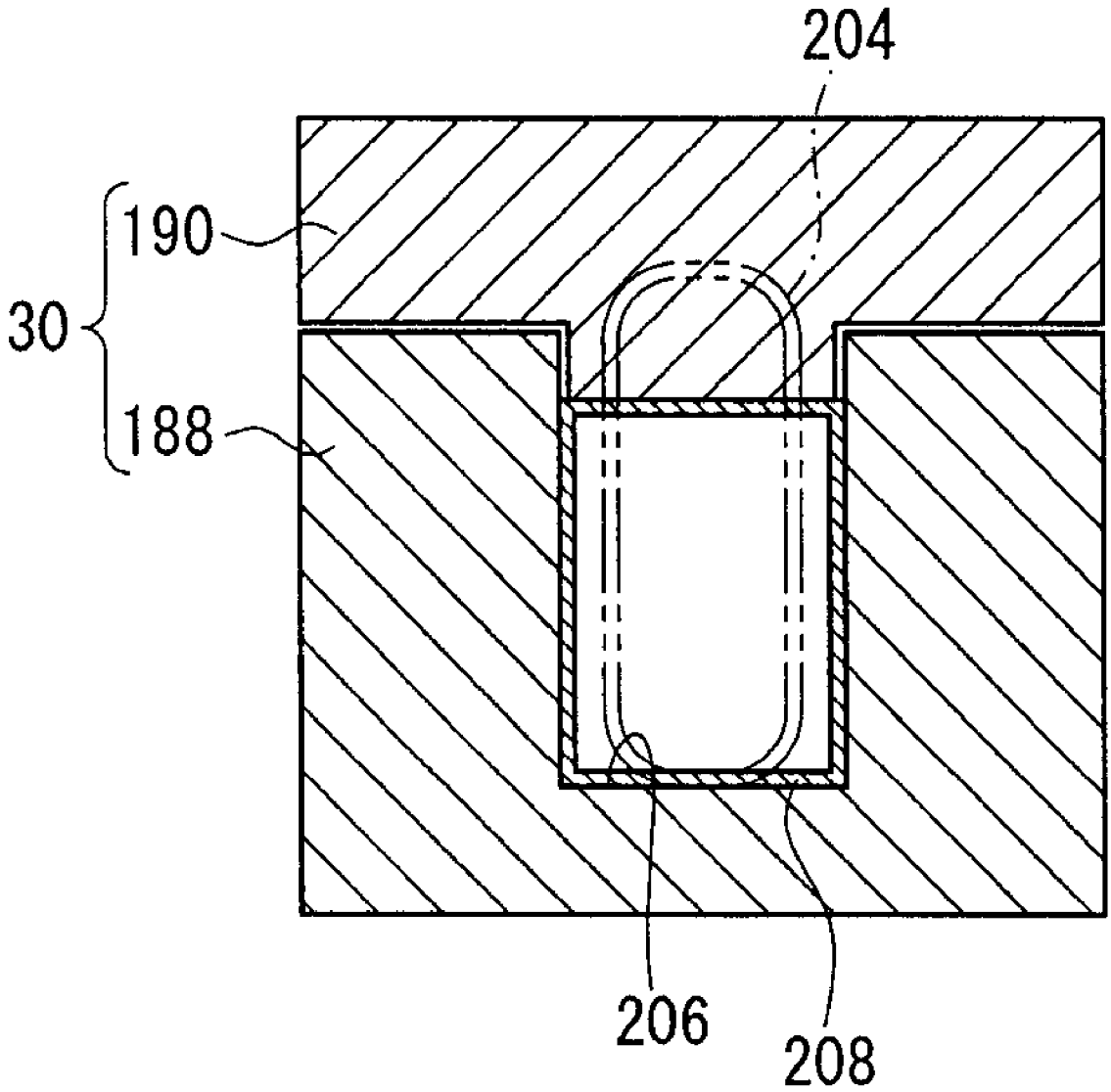
FIG. 13 is a schematic vertical cross-sectional view showing the manner in which a second partly finished product is formed in a main forming process by a third lower die and a third upper die.

When the third lower die 188 abuts against the second partly finished product 204, a cavity 206 is defined as shown in FIG. 13. The second partly finished product 204 is partly squeezed, thereby producing a final formed product 208 shown in FIG. 14.

As can be understood from FIG. 13, the pressing force applied in the main forming process is smaller for pressing the vertically elongate elliptical shape than for pressing the horizontally elongate elliptical shape. The pressing force applied in the main forming process can thus be reduced by turning the second partly finished product. Since the horizontal dimension of the second partly finished product 204 is small, the width of the main forming die 30 which corresponds to the horizontal dimension of the second partly finished product 204 may be reduced.

In the main forming process, the second holding mechanisms 22*b* are horizontally movable as the second partly finished product 204 is formed if the servomotors 54 are held in a servo-free state.

When the main forming process is finished, the compressed air is discharged, and the workpiece gripping cylinders 62 are actuated. Specifically, the rods 64 are retracted in the direction indicated by the arrow X2 in FIG. 4, releasing the final formed product 208 from the second holding mechanisms 22*b*, 22*b* onto the third lower die 188.

Thereafter, the third lower die cylinder 192 is actuated to lower the third lower die 188 with the final formed product 208 placed thereon.

The final formed product 208 placed on the third lower die 188 is gripped by a robot having a take-out jig. An ejector on the third lower die 188 is actuated to release the final formed product 208 from the third lower die 188. The released final formed product 208 is taken out by the robot, and then fed to a next process.

Figure 14:
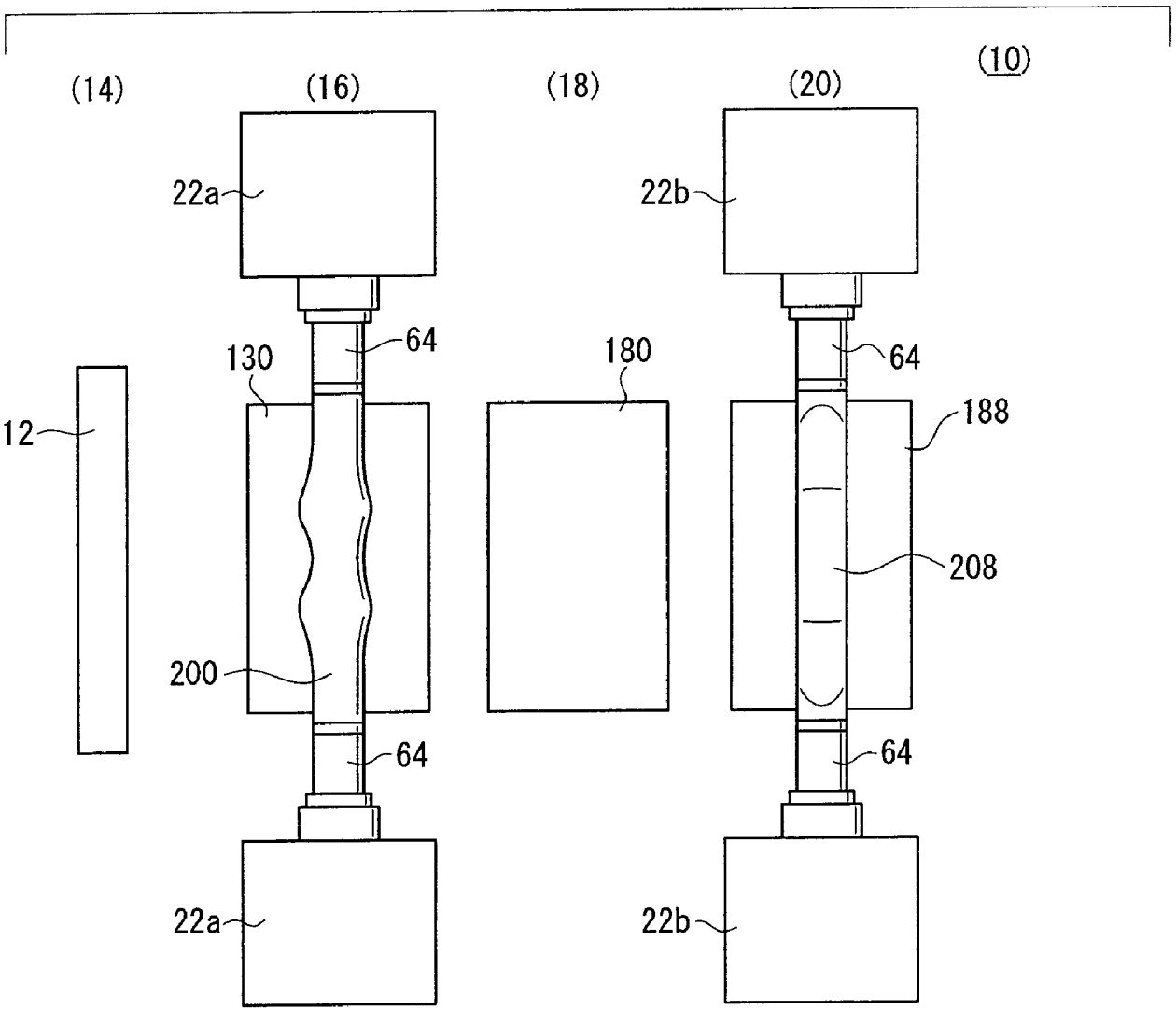
FIG. 14 is a schematic plan view showing the manner in which the second partly finished product gripped by the second holding mechanisms is being formed in the main forming process and the second workpiece gripped by the second holding mechanisms is being expanded.

At the same time that the second partly finished product 204 is delivered to the main forming station 20 by the displacement of the second holding mechanisms 22*b*, the straight tube 12 is delivered to the tube expanding station 16 by the displacement of the first holding mechanisms 22*a*, as shown in FIG. 14. Stated otherwise, at the same time that the main forming process is performed on the second partly finished product 204, the tube expanding process is performed on the straight tube 12. A third straight tube 12 is provided in the heating station 14.

Figure 15:
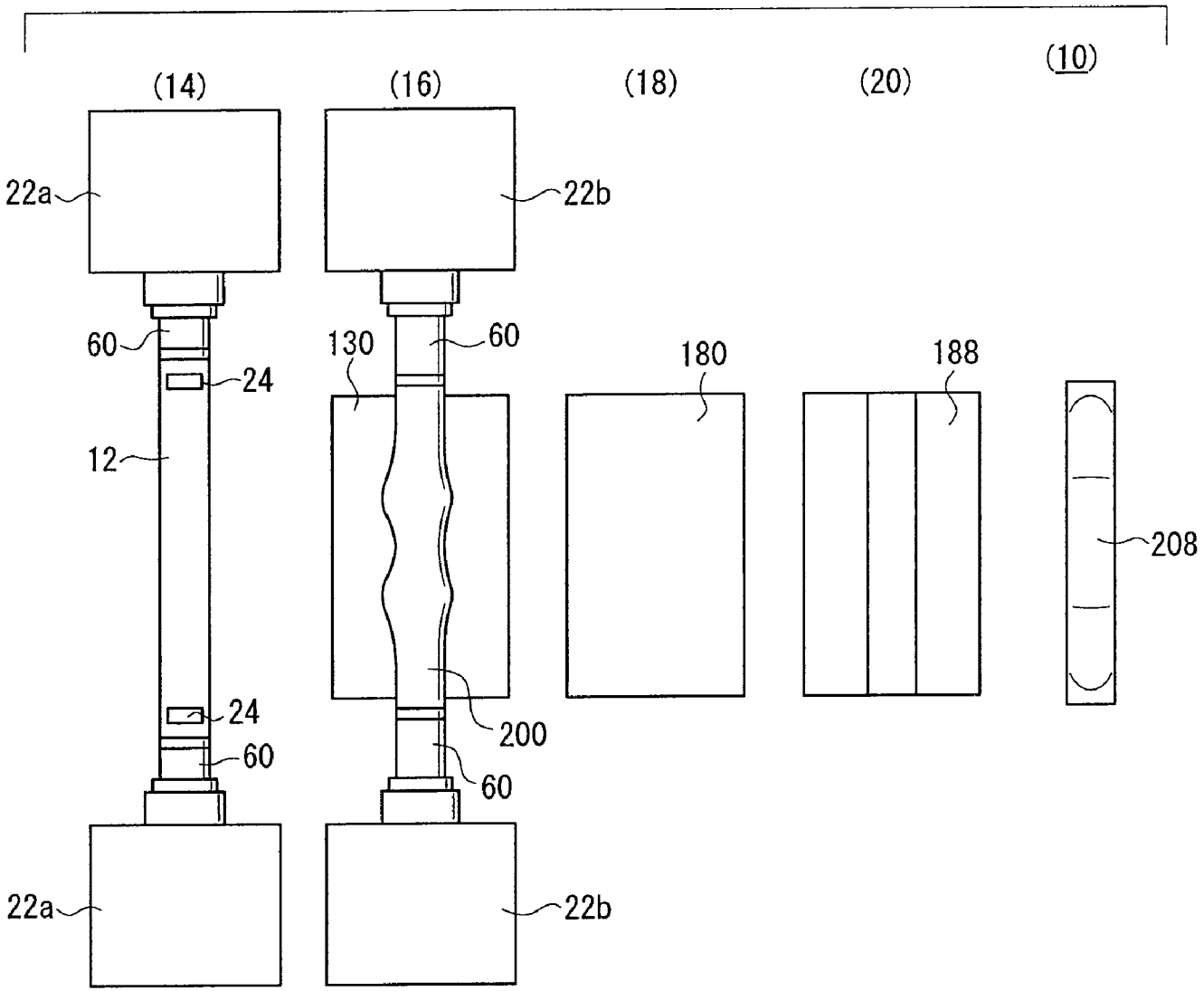
FIG. 15 is a schematic plan view showing the manner in which the first holding mechanisms that have returned to the heating station grip a third workpiece and the second holding mechanisms that have returned to a tube expanding station grips the second workpiece.

When the main forming process on the second partly finished product 204 is finished, as mentioned above, the second holding mechanisms 22*b* release the final formed product 208 (the first straight tube 12), and the first holding mechanisms 22*a* release the first partly finished product 200 (the second straight tube 12). As shown in FIG. 15, the final formed product 208 is ejected, and the first holding mechanisms 22*a*, 22*a* return to the heating station 14 to grip the third straight tube 12, and the second holding mechanisms 22*b*, 22*b* return to the tube expanding station 16 to grip the first partly finished product 200. Subsequently, a procedure similar to the above procedure will be repeated.

According to the present embodiment, the straight tube 12 as a workpiece is held by the first holding mechanisms 22*a*, 22*a* or the second holding mechanisms 22*b*, 22*b*, and delivered between the dies 26, 28, 30. Therefore, the dies 26, 28, 30 do not need to be moved.

According to the first embodiment, the dies 26, 28, 30 are juxtaposed. Therefore, the apparatus is not complex in structure, and the dies 26, 28, 30 do not need to be movably installed. As there is no need to move the dies 26, 28, 30 which are heavy, the cycle time is shortened.

The first embodiment is advantageous in that since the apparatus is constructed to deliver the workpiece 12 between the dies 26, 28, 30, the apparatus is structurally simpler, operates more simply, and has a shorter cycle time until the final formed product 208 is obtained, than if the workpiece 12 is delivered between the dies 26, 28, 30 by a robot.

According to the first embodiment, furthermore, two straight tubes 12, 12 can simultaneously be formed. Therefore, the cycle time is shortened.

Figure 16:
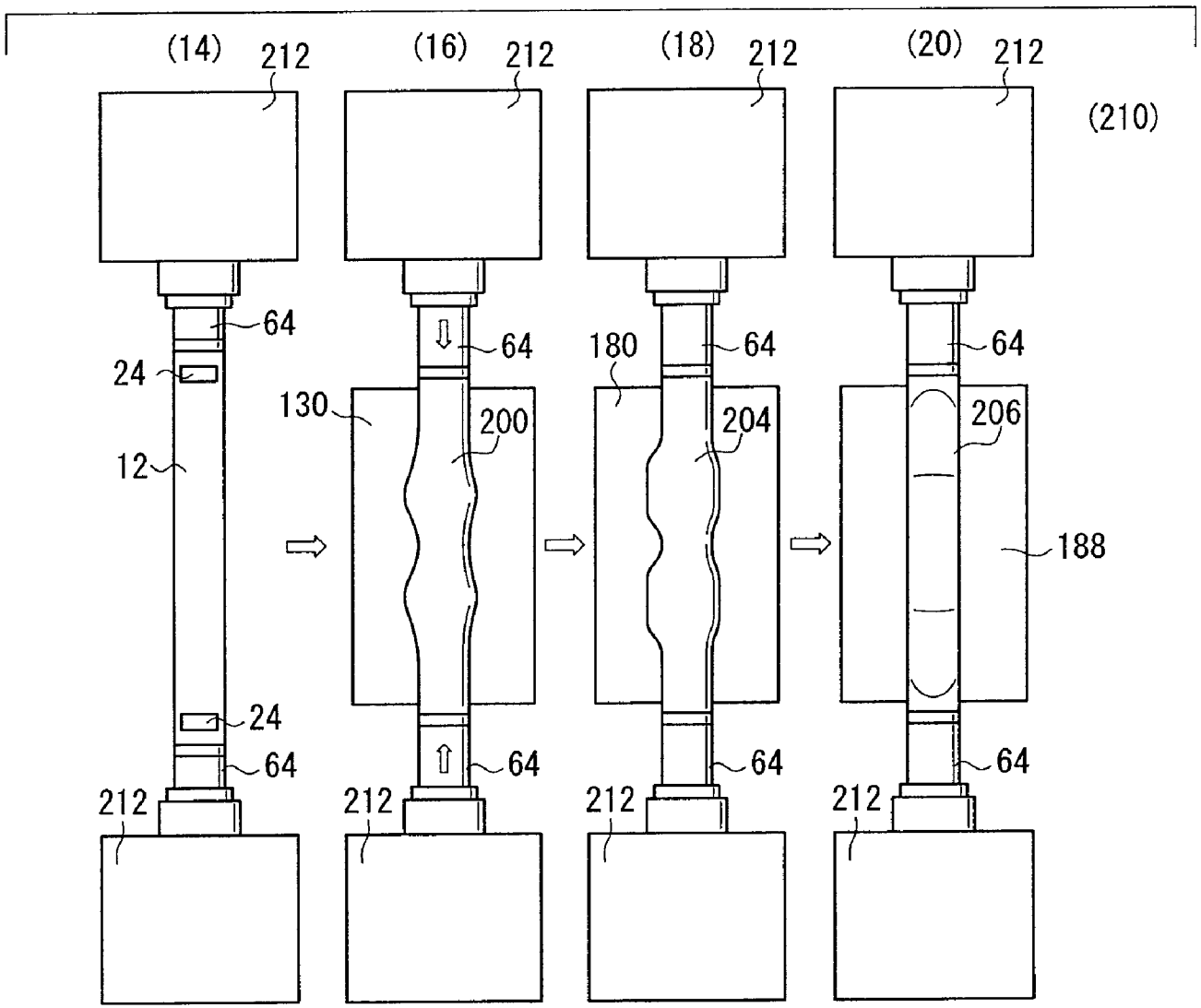
FIG. 16 is a plan view schematically showing, from above, a bulging apparatus according to a second embodiment.

A bulging apparatus according to a second embodiment will be described below. FIG. 16 is a plan view schematically showing, from above, a bulging apparatus 210 according to a second embodiment.

The bulging apparatus 210 is constructed in accordance with the bulging apparatus 10 according to the first embodiment except that it has a set of holding mechanisms 212 which are identical in structure to the first and second holding mechanisms 22*a*, 22*b*. Various components are constructed and operate in the same manner as with the first embodiment.

In the bulging apparatus 210 according to the second embodiment, the holding mechanisms 212, 212 grip a workpiece and are displaced between the stations 14, 16, 18, 20. Specifically, a straight tube 12 is first gripped by the holding mechanisms 212, 212 in the heating station 14 and heated by the heating electrodes 24. The holding mechanisms 212 are displaced to the tube expanding station 16 in the same manner as with the first embodiment to deliver the straight tube 12 to the expanding station 16.

Then, the straight tube 12 is expanded in the tube expanding station 16, producing a first partly finished product 200. The first partly finished product 200 is delivered to the preforming station 18 when the holding mechanisms 212 are displaced to the preforming station 18.

The first partly finished product 200 is preformed in the preforming station 18, producing a second partly finished product 204. The second partly finished product 204 is delivered to the main forming station 20 when the holding mechanisms 212 are displaced to the main forming station 20. Finally, the main forming process is performed on the second partly finished product 204 in the main forming station 20, producing a final formed product 208.

As described above, the workpiece can be delivered between the dies 26, 28, 30 by only the single set of holding mechanisms 212, 212.

In the above embodiments, compressed air is introduced into the straight tube 12. The workpiece is not limited to the straight tube 12 whose cross-sectional shape is circular, but may be a hollow member whose cross-sectional shape is polygonal.

In each of the first and second embodiments, the bulging apparatus has the heating station 14, the tube expanding station 16, the preforming station 18, and the main forming station 20. However, both the bulging apparatus 10, 210 may be arranged so as to be free of the heating station 14.

In the second embodiment, the tube expanding station 16 and the main forming station 20 may make up a bulging apparatus. If necessary, the heating station 14 may be added.

At any rate, the holding mechanisms 22*a*, 22*b*, 212 may be translated in at least one of the horizontal direction and the vertical direction.

The invention claimed is:

1. A bulging method for performing a forming process on a hollow member by introducing a fluid under pressure thereinto, comprising the steps of:

gripping said hollow member at opposite ends thereof with rods of first holding mechanisms, wherein said rods are movable back and forth and have fluid pressure passages defined therein;

introducing a fluid under pressure into said hollow member gripped by said rods to expand said hollow member, and stopping the expansion of said hollow member by contact with a tube expanding die;

displacing said first holding mechanisms from said tube expanding die to a preforming die with displacing mechanisms to deliver the expanded hollow member to said preforming die;

preforming said hollow member with said preforming die;

gripping said hollow member at the opposite ends thereof with rods of second holding mechanisms, wherein said rods are movable back and forth and have fluid pressure passages defined therein, displacing said second holding mechanisms from said preforming die to a main forming die with displacing mechanisms to deliver the preformed hollow member to said main forming die; and forming said hollow member into a product shape with said main forming die.

2. A bulging method according to claim 1, wherein a forming process is performed on said hollow member by said main forming die after the preformed hollow member is angularly moved.

3. A bulging method according to claim 1, wherein said hollow member is supported so as to be translatable in at least one of a vertical direction and a horizontal direction when said hollow member is preformed or mainly formed.

4. A bulging method for performing a forming process on a hollow member by introducing a fluid under pressure thereinto, comprising the steps of:

gripping said hollow member at opposite ends thereof with rods of holding mechanisms, wherein said rods are movable back and forth and have fluid pressure passages defined therein;

introducing a fluid under pressure into said hollow member gripped by said rods to expand said hollow member, and stopping the expansion of said hollow member by contact with a tube expanding die;

displacing said holding mechanisms from said tube expanding die to a main forming die with displacing mechanisms to deliver the expanded hollow member to said main forming die; and forming said hollow member into a product shape with said main forming die.

5. A bulging method according to claim 4, further comprising the step of preforming said hollow member with a preforming die which is disposed between said tube expanding die and said main forming die.

6. A bulging method according to claim 5, wherein a forming process is performed on said hollow member by said main forming die after the preformed hollow member is angularly moved.

7. A bulging method according to claim 4, wherein said hollow member is supported so as to be translatable in at least one of a vertical direction and a horizontal direction when said hollow member is preformed or mainly formed.

8. A bulging apparatus for performing a forming process on a hollow member by introducing a fluid under pressure thereinto, comprising:

first holding mechanisms and second holding mechanisms having rods for gripping said hollow member at opposite ends thereof, wherein the rods are movable back and forth and have fluid pressure passages defined therein;

a tube expanding die disposed at a first station, for stopping expansion of said hollow member which is gripped by said rods while said hollow member is expanding as a result of a fluid under pressure being introduced into said hollow member;

a preforming die disposed at a second station adjacent to said first station, for preforming the expanded hollow member;

a main forming die disposed at a third station adjacent to said second station, for forming the preformed hollow member into a product shape; and displacing mechanisms for delivering said hollow member between the first, second, and third stations by displacing said first holding mechanisms from said tube expanding die to said preforming die or from said preforming die to said tube expanding die, and displacing said second holding mechanisms from said preforming die to said main forming die or from said main forming die to said preforming die.

9. A bulging apparatus according to claim 8, further comprising turning mechanisms for angularly moving said first holding mechanisms and said second holding mechanisms.

10. A bulging apparatus according to claim 8, further comprising a heating unit for heating said hollow member to be delivered to said tube expanding die.

11. A bulging apparatus according to claim 8, further comprising at least one of lifting/lowering mechanisms for vertically translating at least one of said first holding mechanisms and said second holding mechanisms, and translating mechanisms for horizontally translating at least one of said first holding mechanisms and said second holding mechanisms.

12. A bulging apparatus for performing a forming process on a hollow member by introducing a fluid under pressure thereinto, comprising:

holding mechanisms having rods for gripping said hollow member at opposite ends thereof, the rods being movable back and forth and having fluid pressure passages defined therein;

a tube expanding die disposed at a first station, for stopping expansion of said hollow member which is gripped by said rods while said hollow member is expanding as a result of a fluid under pressure being introduced into said hollow member;

a main forming die disposed at a third station adjacent to said first station for forming the expanded hollow member into a product shape; and displacing mechanisms for delivering said hollow member from the tube expanding die to the main forming die by displacing said holding mechanisms from said tube expanding die to said main forming die and from said main forming die to said tube expanding die.

13. A bulging apparatus according to claim 12 further comprising a preforming die disposed at a second station between said first station and said second station, for preforming the expanded hollow member, and wherein the displacing mechanism displaces said holding mechanisms from said tube expanding die to said preforming die, from said performing die to said tube expanding die, from said performing die to said main forming die, and from said main forming die to said performing die.

14. A bulging apparatus according to claim 13, further comprising turning mechanisms for angularly moving said holding mechanisms.

15. A bulging apparatus according to claim 12, further comprising a heating unit for heating said hollow member to be delivered to said tube expanding die.

16. A bulging apparatus according to claim 12, further comprising at least one of lifting/lowering mechanisms for vertically translating said holding mechanisms, and translating mechanisms for horizontally translating said holding mechanisms.

* * * * *